US006230758B1

(12) United States Patent
Krumm et al.

(10) Patent No.: US 6,230,758 B1
(45) Date of Patent: May 15, 2001

(54) METHOD FOR CONTROLLING A MOTION CHARACTERISTIC OF A SLEY SHAFT FOR DRIVING A REED

(75) Inventors: Valentin Krumm, Hergensweiler; Stefan Kimmel, Weissensberg; Rainer Finger, Lindau, all of (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 09/580,284

(22) Filed: May 30, 2000

(30) Foreign Application Priority Data

May 28, 1999 (DE) ..... 199 24 627

(51) Int. Cl.[7] ..... D03D 49/60; D03D 39/22
(52) U.S. Cl. ..... 139/188 R; 139/26; 139/190
(58) Field of Search ..... 139/190, 26, 188 R

(56) References Cited

U.S. PATENT DOCUMENTS 3,749,137 7/1973 Jaeger .
5,058,628 * 10/1991 Spiller et al. ..... 139/26
5,285,820 * 2/1994 Bassing ..... 139/190
5,423,354 * 6/1995 Herrlein ..... 139/26

FOREIGN PATENT DOCUMENTS 200343 12/1938 (CH) .
559886 9/1932 (DE) .
593960 2/1934 (DE) .
4111405 10/1992 (DE) .

* cited by examiner

*Primary Examiner*—Andy Falik
(74) *Attorney, Agent, or Firm*—W. F. Fasse; W. G. Fasse

(57) ABSTRACT

The sley shaft of a loom, particularly a loom for weaving terry cloth or pile fabric, is rotated so as to provide more time for a gentle beat-up of the weft along the fabric beat-up line. For this purpose, the acceleration of the sley shaft and thus of the reed, which is connected to the sley shaft, toward the beat-up position is first faster to provide more time for the following entrainment of the weft or a group of wefts and for their beat-up by way of a discontinuous deceleration of the sley shaft and reed by a two phase deceleration toward the beat-up line. The two phase deceleration is interrupted by a slower deceleration between the two deceleration phases or by no deceleration between the two deceleration phases. Weft entrainment takes place between the two deceleration phases.

14 Claims, 3 Drawing Sheets

PRIOR ART FIG. 1

METHOD FOR CONTROLLING A MOTION CHARACTERISTIC OF A SLEY SHAFT FOR DRIVING A REED

PRIORITY CLAIM

This application is based on and claims the priority under 35 U.S.C. §119 of German Patent Application 199 24 627.0, filed on May 28, 1999, the entire disclosure of which is incorporated herein by reference.

FIELD OF THE INVENTION

The invention relates to a method for controlling the back and forth motion characteristic of a sley shaft for driving a reed in a weaving loom, particularly a pile fabric or terry cloth weaving loom. The motion of the sley shaft is derived from a cam drive disk driven by the main loom drive shaft and driving a cam follower connected to the sley shaft.

BACKGROUND INFORMATION

German Patent Publication DE 41 11 405 C2 discloses a drive for the sley of a loom by means of bellcrank levers which are movable by an eccentric cam drive disk. One end of the bellcranks is journalled to the sley and the other end is journalled to the loom frame. This type of conventional bellcrank drive is intended to achieve a high operational speed even in large looms while still providing a sufficient time duration for the rest position of the sley for proper weft insertion.

The disclosure of the just mentioned German Patent Publication achieves this purpose in that the shaft that drives the cam disk is driven by a drive motor which is controllable in its r.p.m. in such a way that the shaft rotates at a higher r.p.m. when the sley is to be moved from its beat-up position along the beat-up line of the fabric into the retracted rear position and also when the sley is moved from the rear position to the beat-up position. By accelerating the sley motions in both directions the time duration for the rest position of the sley and reed is extended when the sley is stationary due to the configuration of the cam disk, the drive shaft rotates at a lower r.p.m. namely in the range of rotation when the sley is at rest.

According to the above conventional sley movement control it is important that the shaft which drives the cam disk is controllable in its r.p.m. by controlling the shaft drive motor.

It is further important that the time duration for the forward and backward move of the sley can be shortened by the higher drive r.p.m. to thereby provide the required extended rest time duration for the sley and reed.

Such a motion sequence of the sley, namely fast stop fast, is detrimental to the weaving of so-called pile fabric or terry cloth because a uniform pile formation is adversely affected by such motion sequence. This is so because a fast moving reed which is connected to the sley, necessarily cannot on its way to the beat-up line entrain the weft thread or a group of weft threads in a gentle manner. As a result of the relatively high speed of the reed during its beat-up motion toward the beat-up line the pile warp threads that must be formed into loops are at least partially pulled out of the weft thread group, whereby the resulting loops or piles have different lengths. If such a fabric is subsequently passed through a shearing operation, the loops or piles of smaller lengths are not cut by the shearing knives so that the appearance of the fabric is non-uniform. In other words, the terry cloth has a non-uniform appearance.

Another undesirable result of the high speed entrainment of the weft threads or weft thread groups by the reed is seen in that breaking of the warp threads and/or of the weft threads occurs frequently particularly of the base warp threads as well as of the pile warp threads.

OBJECTS OF THE INVENTION

In view of the above it is the aim of the invention to achieve the following objects singly or in combination:

- to avoid damage to the warp threads and to the weft threads by controlling the beat-up motion of the reed in a loom, particularly a terry cloth weaving loom;
- to control the motion sequence imparted by a sley drive to the reed in such a way that the reed motion toward the beat-up and the beat-up itself do not damage the weft threads, nor the base warp threads, nor the pile warp threads;
- to avoid the formation of piles or loops of different heights in a terry cloth or pile fabric by making certain that all piles or loops have a uniform height or length;
- to shape the cam disk for driving the sley shaft through a cam follower in a loom for weaving terry cloth in such a way that a smooth pile or loop formation is assured for weaving high quality terry cloth or pile fabric having a uniform appearance;
- to drive the cam disk with a constant r.p.m. independently of whether the drive motor for the shaft that rotates the cam disk, can be or cannot be controlled in its motor r.p.m.; and
- to impose a discontinuity into the deceleration of the reed as it moves toward the beat-up line whereby the deceleration may be slowed down temporarily or briefly discontinued altogether to provide a constant reed velocity at the time of the weft entrainment.

SUMMARY OF THE INVENTION

The method according to the invention for controlling a motion characteristic or curve of a sley shaft and thus of the reed in a loom, particularly a loom for weaving terry cloth or pile fabric, is performed in a loom having a main loom drive shaft that drives a cam drive such as a cam disk which in turn cooperates with a cam follower connected to the sley shaft. The present method is characterized by the following steps:

a) driving the sley shaft through said cam drive;
b) first accelerating the sley shaft from a zero velocity in a return rotation direction to a first maximum for returning the reed into a rear position opposite a beat-up position following a beat-up motion of the reed;
c) first decelerating said sley shaft to a first rotation reversal point;
d) first reversing said rotation direction and providing a reed rest period for a weft insertion;
e) second accelerating said sley shaft in an opposite beat-up direction to a second velocity maximum; and
f) second discontinuously decelerating said sley shaft in at least a first deceleration phase and a second deceleration phase, wherein said first deceleration phase extends between a first angular position where said second velocity maximum is reached and a second angular position where said reed is entraining an inserted weft or group of wefts for beat-up, and wherein said second deceleration phase extends from said entraining of said weft to a beat-up of said weft at a beat-up line of the fabric.

The second acceleration according to the invention for starting a new beat-up motion of the sley shaft and thus of the reed takes place out of the rest position in which the sley shaft and reed are in the rearmost position. The second acceleration takes place during an angular range of more than 1° to a second return velocity maximum whereupon the angular velocity of the sley shaft is controlled or rather decelerated in a discontinuous manner until the beat-up or forward end position of the reed is achieved at which point again a reversal of the rotational direction takes place. The second velocity maximum is preferably reached within an angular range of less that 160° of a full 360° revolution of the drive cam disk, whereupon the forward motion of the sley shaft and the reed are decelerated to a point where the weft or a group of weft threads are entrained by the reed and following that point further deceleration is applied to complete the beat-up. This discontinuous control of the deceleration of the sley shaft and reed on their way to the beat-up line makes sure that the weft or weft thread group for forming the pile or loops is entrained with a reduced angular velocity or even a constant angular velocity of the reed if the deceleration is not merely slowed down but is briefly fully interrupted.

This discontinuous reduction of the angular velocity of the reed on its way to beat-up in at least two phases has the following advantages. A high quality fabric appearance, particularly of terry cloth is achieved simultaneously with a loom structural advantage that a control of the dancing or looping roller for maintaining the pile warp tension is no longer necessary. According to the invention the deceleration according to the invention permits maintaining a higher warp tension particularly in the pile warp threads at all times. Thus, further devices such as a so-called lamella support board is no longer necessary because the warp tension of the pile warp threads can be sufficiently increased so that lamella of a warp stop motion device do not require any support. Furthermore, due to the uniform pile or loop height the waste that conventionally occurs during the shearing operation is substantially reduced compared to pile heights of different size.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 3:
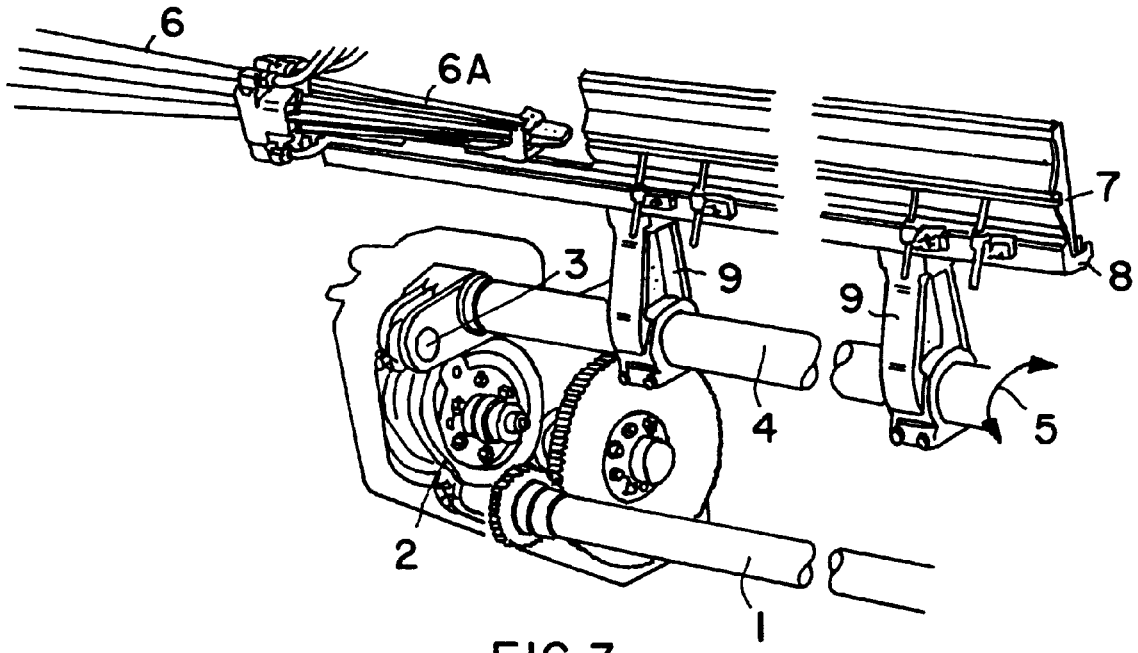
FIG. 3 is a perspective simplified view of the main loom drive shaft driving a sley shaft through a cam disk and cam follower drive.

FIG. 3 provides background information and shows a main loom drive shaft 1 for driving a drive cam disk 2 cooperating with a cam follower 3 to drive the sley shaft 4 back and forth as indicated by a rotational double arrow 5. Weft threads or groups of weft threads 6 are conventionally inserted by inserting means 6A into a weft insertion channel 7 of a read secured to the reed bar 8. the reed bar 8 is secured to the sley shaft 4 by carrier arms 9.

Figure 1:
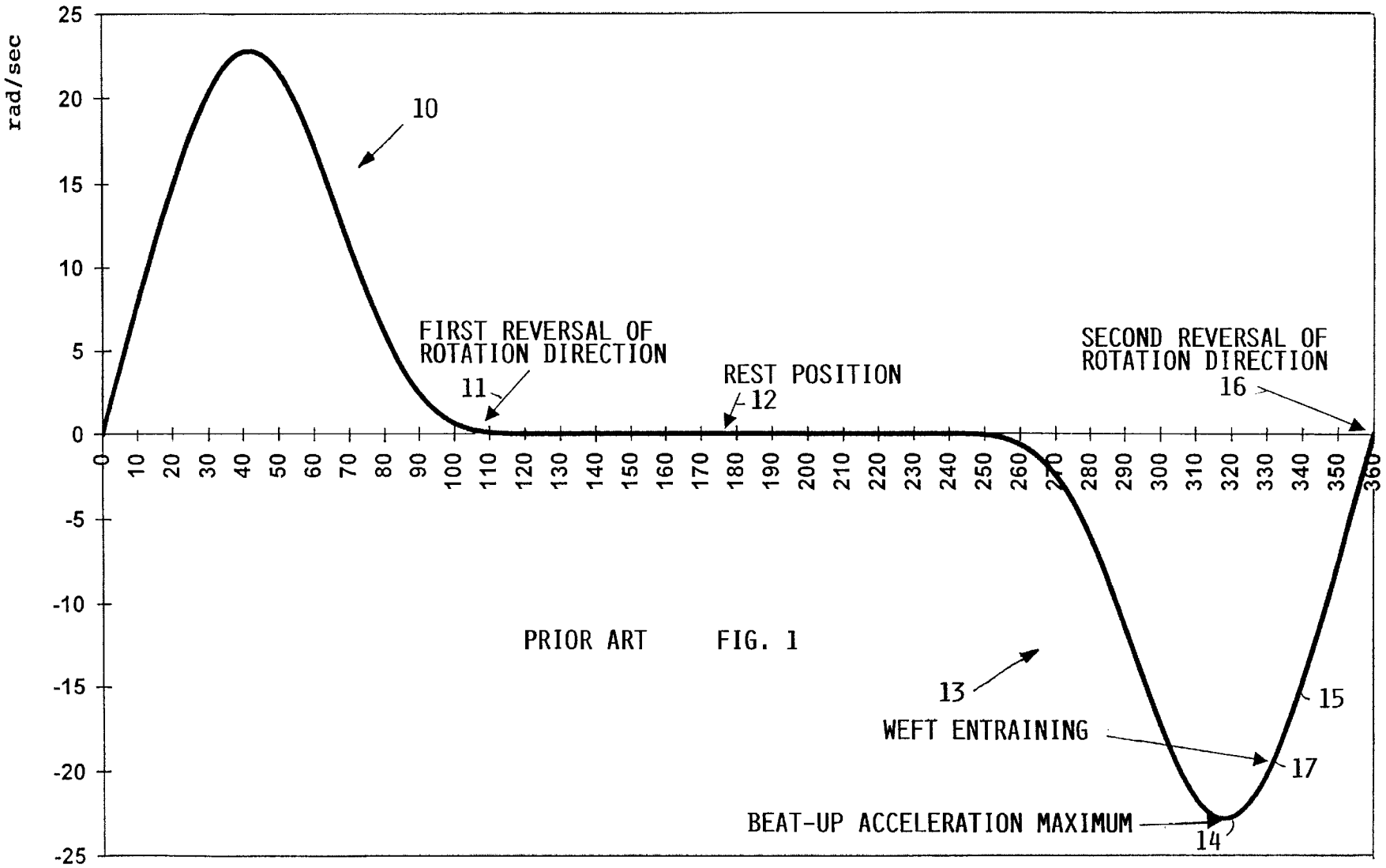
FIG. 1 illustrates a conventional motion characteristic of a sley shaft showing an angular velocity in degrees per second as a function of the degrees of one revolution of a cam drive disk.

FIG. 1 illustrates a motion characteristic of a conventional cam drive for the sley shaft 4 through the cam disk 2 and cam follower 3. The angular velocity in radian per second is shown on the ordinate as a function of one full revolution of the cam disk 2 of 360° shown on the abscissa. Following a beat-up at 0°, the return motion of the reed is shown as a curve 10 with a first positive peak at about 45°. The curve starts at 0°, peaks at an angular velocity of about $23^{rad}$/sec. (radian per second) at about 45° of rotation and then decelerates to a first point 11 where the rotation direction is first reversed when the reed has reached its rearmost position away from the beat-up position at about 105° of rotation of the cam disk 2. The first direction reversal is followed by a rest position or rather rest duration 12 during which the reed does not move. The weft threads or groups of weft threads are inserted during this rest duration when the reed is stationary. Following the rest position or duration 12 an acceleration in the opposite direction takes place as shown by the curve 13 now shown in the negative direction to indicate motion in the opposite direction relative to the return direction shown by the curve 10. The return motion or acceleration begins between about 250° to 260° of the revolution of the drive cam disk 2 and reaches its peak 14 at about 310° to 320° of rotation with an angular velocity of about $23^{rad}$/sec. The beat-up motion is then continuously decelerated along the curve portion 15 until one revolution is completed at 16 where a second reversal of the rotation direction takes place. The weft thread or group of weft threads is entrained by the reed at about point 17 on the deceleration curve portion 15. The entraining of the weft or weft thread group for the pile formation takes place at a relatively high velocity of the reed of about $20^{rad}$/sec. which does not treat the weft threads gently. The beat-up takes place at 16 when the cam drive disk 2 has completed a full revolution. The rapid entrainment at a still relatively high reed velocity leads to the above mentioned disadvantages, not only to the weft threads; but also to the warp threads.

Incidentally, the term "about" as used herein in connection with the indication of rotational degrees is intended to cover degree deviations within the range of ±5° of cam rotation.

Figure 2:
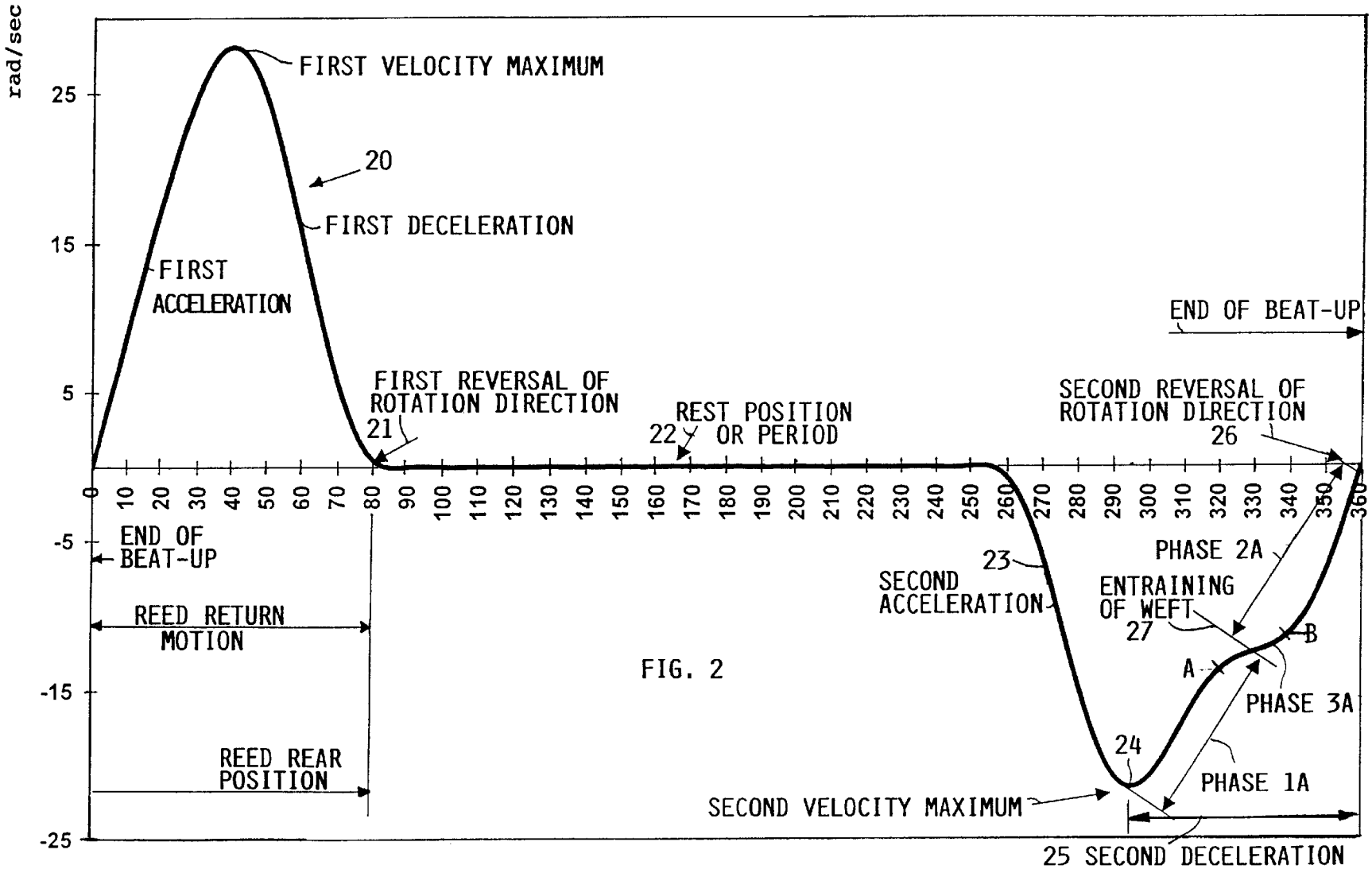
FIG. 2 is a view similar to that of FIG. 1, however illustrating a sley motion sequence modified according to the invention.

FIG. 2 shows the motion characteristic of the cam drive disk 2 according to the invention, whereby again the angular velocity is shown in radian per second on the ordinate and the rotational degrees for one revolution of the cam drive disk 2 are shown on the abscissa. It will be noted that the reed return motion indicated by the first curve 20 with a positive peak takes up fewer rotational degrees for the first acceleration and deceleration compared to FIG. 1. Thus, the curve 20 according to the invention for the reed return motion takes up about 80° of rotation of the cam disk compared to about 100° of rotation in a conventional drive. This provides advantageously more time for the rest period 22 of the reed and hence for the weft thread insertion.

The first deceleration is followed at 21 by a first reed rotation direction reversal which in turn is followed by the rest period 22. The second acceleration 23 in the opposite or beat-up direction for moving the reed toward the beat-up line is steeper according to the invention than conventionally. Thus, the second acceleration 23 reaches its peak 24 at about $23^{rad}$ per second within an angular range of about 40°, namely from 255° to 295° compared to about 60° in the conventional drive, namely from 255° to 315°. This feature of the invention provides more time for the second deceleration 25 of the reed movement toward the beat-up line that is reached at point 26 or 360°. According to the invention the second deceleration 25 takes place in a discontinuous pattern along the angular range of about 295° to 360° of disk 2 rotation, whereby the second deceleration 25 takes place in at least two phases 1A and 2A. Phase 1A starts at about 295° and ends at about 300° at which point the angular velocity of the reed is about 13 radian per second which is substantially lower than the 20 radian per second in the conventional drive. The weft entraining according to the invention takes place at the above mentioned substantially lower angular velocity, namely where the first phase 1A ends and where the second phase 2A begins for the final deceleration of the reed toward the beat-up point 26 at 360° where a second reversal of the rotation direction takes place to repeat the cycle of returning the reed into the rear position.

Referring further to FIG. 2, the transition between the first deceleration phase 1A and the second deceleration phase 2A according to the invention could be considered as a third phase 3A during which the entraining of the weft takes place. The third phase 3A would extend from point A where the deceleration curve first changes direction to a point B where it changes direction again. According to the invention any type of deceleration reduction can be provided between the points A and B. For example, the curve portion of phase 3A between the directional change points A and B could extend almost or completely horizontally to provide a constant angular velocity at the time of weft entraining at 27.

Tests comparing the conventional drive characteristic represented By FIG. 1 with a drive according to the invention represented by FIG. 2 have shown that the discontinuous deceleration of the sley shaft and thus of the reed on a loom for weaving terry cloth results in a high quality terry cloth according to the invention which cannot be achieved by a conventional drive due to the non-uniform pile heights described above.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for controlling a motion characteristic of a sley shaft for driving a reed in a weaving loom having a main loom drive shaft, a cam drive including a drive cam disk operated by said main loom drive shaft and a cam follower connected to said sley shaft and cooperating with said cam disk, said method comprising the following steps:

(a) driving said sley shaft through said cam drive, (b) first accelerating said sley shaft from a zero velocity to a reed return maximum velocity for moving said reed into a rear rest position opposite a beat-up position, (c) first decelerating said sley shaft to a first rotation reversal point where said reed reaches said rear rest position, (d) providing a reed rest period for a weft thread insertion when said reed is in said rear rest position, (e) second accelerating said sley shaft in an opposite beat-up direction to a beat-up velocity maximum, and (f) second discontinuously decelerating said sley shaft in at least a first deceleration phase (1A) and a second deceleration phase (2A), wherein said first deceleration phase (1A) extends between a first angular position where said beat-up velocity maximum is reached and a second angular position where said reed is entraining an inserted weft thread or a group of weft threads for beat-up, and wherein said second deceleration phase (2A) extends from said entraining of said weft thread or group of weft threads to beat-up of said weft thread or group of weft threads at a beat-up line along a fabric.

2. The method of claim 1, further comprising performing said second acceleration of said sley shaft within an angular range of more than one degree and less than 160° of a full drive cam disk revolution of 360°.

3. The method of claim 1, wherein an end of said first deceleration phase coincides with the completion of an insertion of said weft thread or said group of weft threads into a warp shed for weaving terry cloth.

4. The method of claim 1, further comprising performing a first reversing of a reed rotation direction when said reed is in said rear rest position, and performing a second reversing of said reed rotation direction when said reed is in said beat-up position when a weft beat-up is completed.

5. The method of claim 1, further comprising operating said drive cam disk at a constant r.p.m.

6. The method of claim 1, further comprising providing a third deceleration phase between said first and second deceleration phases of said second deceleration, and wherein deceleration during said third phase is slower than in said first and second deceleration phases.

7. The method of claim 6, wherein said second decelerating is performed within an angular range, from about 295° to about 360°, wherein said first deceleration phase is performed within an angular range from about 295° to about 315°, wherein said third deceleration phase is performed within an angular range from about 315° to about 340°, and wherein said second deceleration phase is performed within an angular range from about 340° to 360°.

8. The method of claim 6, wherein a sum of the angular rotation ranges of said first, second and third deceleration phases is larger than an angular range of said second acceleration for providing more time for all phases of said second deceleration than for said second acceleration.

9. The method of claim 8, wherein said sum of said angular rotation ranges is about 65°, and wherein said angular range of said second acceleration is about 40°.

10. The method of claim 6, wherein said first acceleration and first deceleration are performed within a first angular range that is smaller than a second angular range represented by the sum of the angular ranges of said second acceleration and of said first phase, said second phase and said third phase of said second deceleration.

11. The method of claim 10, wherein said first angular range is about 80° and said second angular range-is about 105°.

12. The method of claim 6, further comprising entraining said weft thread or said group of weft threads during said third deceleration phase for a following beat-up.

13. The method of claim 1, further comprising providing a third phase between said first and second deceleration phases, and interrupting deceleration during said third phase so that entraining of said weft thread or of said group of weft threads during said third phase takes place at a temporarily constant angular velocity of said reed.

14. The method of claim 13, wherein said third phase extends through an angular range of about 20°.

* * * * *